US011259590B2

(12) United States Patent
Wright et al.

(10) Patent No.: US 11,259,590 B2
(45) Date of Patent: Mar. 1, 2022

(54) HEATED BOOT COVER

(71) Applicant: Boiler Room Outdoors, LLC, Richmond, TX (US)

(72) Inventors: Derek Wright, Liberty Hill, TX (US); Brian Schrock, Liberty Hill, TX (US)

(73) Assignee: Boiler Room Outdoors, LLC, Richmond, TX (US)

( * ) Notice: Subject to any disclaimer, the term of this patent is extended or adjusted under 35 U.S.C. 154(b) by 0 days.

(21) Appl. No.: 16/359,977

(22) Filed: Mar. 20, 2019

(65) Prior Publication Data

US 2019/0289953 A1 Sep. 26, 2019

Related U.S. Application Data

(63) Continuation-in-part of application No. 62/645,425, filed on Mar. 20, 2018.

(51) Int. Cl.
*A43B 7/04* (2006.01)
*A43B 7/34* (2006.01)

(52) U.S. Cl.
CPC . *A43B 7/04* (2013.01); *A43B 7/34* (2013.01)

(58) Field of Classification Search
CPC .. A43B 7/02; A43B 7/04; A43B 7/025; A43B 7/34
USPC ..... 36/2.6
See application file for complete search history.

(56) References Cited

U.S. PATENT DOCUMENTS

| | | | | |
|---|---|---|---|---|
| 4,376,344 | A | 3/1983 | Kimsey | |
| 5,927,060 | A | 7/1999 | Watson | |
| 9,719,194 | B2 | 8/2017 | Chi-Hsueh | |
| 9,788,605 | B2 | 10/2017 | Reuben | |
| 2010/0212183 | A1* | 8/2010 | Seliger | A43B 7/28 36/2.6 |
| 2010/0300060 | A1 | 12/2010 | Hsu et al. | |
| 2014/0000130 | A1* | 1/2014 | Crist | A43B 7/005 36/136 |
| 2018/0070680 | A1* | 3/2018 | Smith | A43B 7/12 |

* cited by examiner

*Primary Examiner* — Ted Kavanaugh
(74) *Attorney, Agent, or Firm* — Craige Thompson; Thompson Patent Law; Timothy D. Snowden

(57) ABSTRACT

A heated boot cover is disclosed. The heated boot cover comprises a layered material formed into an upper which is attached to a sole. The heated boot cover contains a layer of woven material having an electrically conductive yarn threaded throughout. The heating layer is disposed between a layer of fabric in the internal space of the boot cover and a thermal insulating layer. The outermost layer of material is a water resistant material. The boot cover has a fastener, such as a zipper, which has electrical connections so that the heating element of the boot cover can only be activated when the fastener is secured. The boot cover may have a transceiver which allows the operations of the boot cover to be controlled by a smart phone or other computerized device.

13 Claims, 17 Drawing Sheets

HEATED BOOT COVER

PRIORITY

This application claims priority to U.S. Provisional Application Ser. No. 62/645,425, filed on Mar. 20, 2018, the disclosure of which is hereby fully incorporated by reference.

FIELD OF THE INVENTION

This invention pertains generally to footwear and more specifically to a heated boot cover.

BACKGROUND OF INVENTION

Individuals do many outdoor activities. These outdoor activities require appropriate gear to be worn by individuals. When individuals do outdoor activities during winter months or in colder climates, they often wear boots. Boots may come in many fashions and be made from many materials. Some boots are made from rubber and some are made from fabric or leather. The boots and material that boots are made from often have a heat resistance rating so that the feet of individuals wearing the boots can remain warm. However, the efficiency of the boots of retaining warmth depends greatly on the circumstances of use. For instance, if an individual is highly active outdoors, such as hiking or running, the feet of the individual can remain warm while in use. However, if a person is sitting still and is not active, such as when hunting, then the feet of the individual can quickly become cold. When a person's feet become cold in such circumstances the overall warmth of the person can suffer and the individual is unlikely to remain outdoors. This can lead to missed hunting opportunities. What is needed is a cover for boots which can provide warmth to the boots to keep an individual feeling warm and more likely to remain outdoors.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a shaped personal heating apparatus comprising an upper; a sole connected to said upper; wherein said upper and said sole define a cavity; wherein said upper comprises a first layer facing externally from said personal heating apparatus, a second layer disposed adjacent to said first layer, a third layer disposed adjacent to said second layer, and a fourth layer disposed adjacent to said third layer; wherein said fourth layer is disposed facing said cavity; wherein said third layer comprises an electrically conductive material; and wherein said second layer comprises a thermal insulation material having a thermal insulation value higher than a thermal insulation value of said first layer and a higher thermal insulation value of said third layer.

The upper may be shaped to include a vamp portion and a shaft portion and wherein said electrically conductive material extends through said vamp portion and said shaft portion. The electrically conductive material may further comprise a non-conductive textile core and one or more metallic conductive filaments wrapped around said non-conductive textile core. The electrically conductive material may have a width and a depth and wherein said width of said electrically conductive material is greater than said depth.

The electrically conductive material may comprise a non-conductive textile core and one or more metallic conductive filaments; wherein said non-conductive textile core comprises a plurality of textile filaments; wherein a portion of said non-conductive textile core is configured to have said one or more metallic conductive filaments interwoven with one or more of said plurality of textile filaments.

The personal heating apparatus may further comprise a battery electrically connected to said electrically conductive material of said third layer. The personal heating apparatus may further comprise one or more fasteners connected to said upper; said one or more fasteners having a secured position and an unsecured position.

The personal heating apparatus may further comprise a first electrical contact element integral to a portion of said fastener and a second electrical contact element integral to a second portion of said fastener; wherein electricity will flow through said electrically conductive material only when said first electrical contact element is physically in contact with said second electrical contact element; wherein said first electrical contact element is only in physical contact with said second electrical contact element when said fastener is in a secured position.

The personal heating apparatus may further comprise a microprocessor configured to control the operation of said electrically conductive material and a transceiver in operative communication with a remote computerized device.

The first layer may comprise a polyurethane coated nylon fabric; wherein said second layer may be composed of a synthetic fiber insulation having a thermal resistance value in a range R 1.6 to R 2.9; wherein said third layer may further comprise a woven non-conductive base; and wherein said fourth layer may comprise ripstop nylon.

The invention is also directed toward a method of utilizing a shaped personal heating device wherein said method comprises connecting a battery to said third layer; placing a foot in said cavity; and securing said one or more fasteners.

The method may further comprise placing said fastener in a secured position so that said first electrical contact element comes into contact with said second electrical contact element sufficient to allow a flow of electricity to occur between said first electrical contact element and said second electrical contact element.

The method may further comprise entering an instruction for operation of said shaped personal heating apparatus into said remote computerized device; transmitting said instruction from said remote computerized device to said transceiver of said shaped personal heating device; receiving said instruction by said transceiver of said shaped personal heating device; and altering one or more parameters of operations of said shaped personal heating device by said microprocessor in response to receiving said instruction.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

As used in this application, the terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component.

Figure 1:
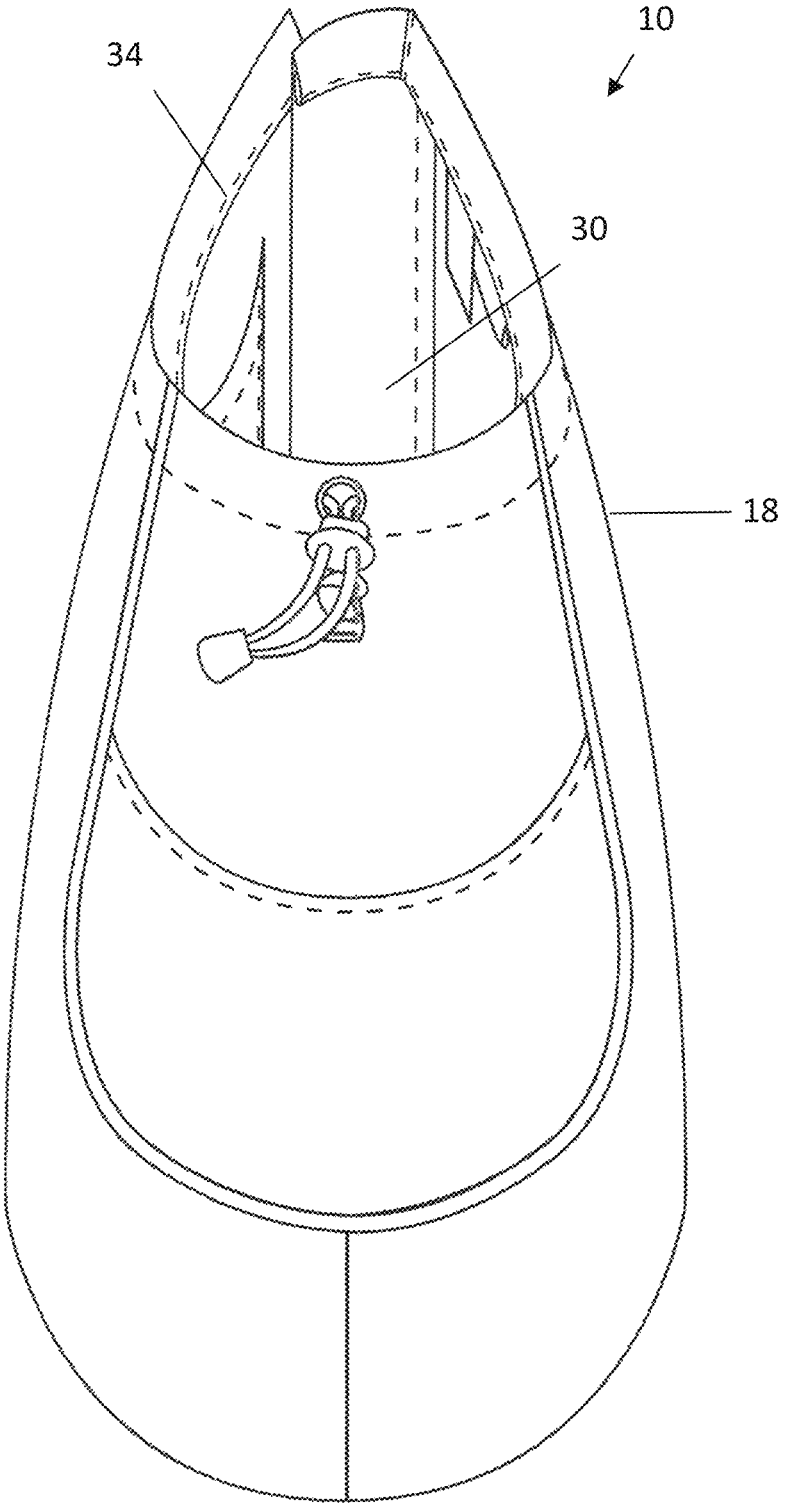
FIG. 1 is a top perspective view of the boot cover.
Figure 2:
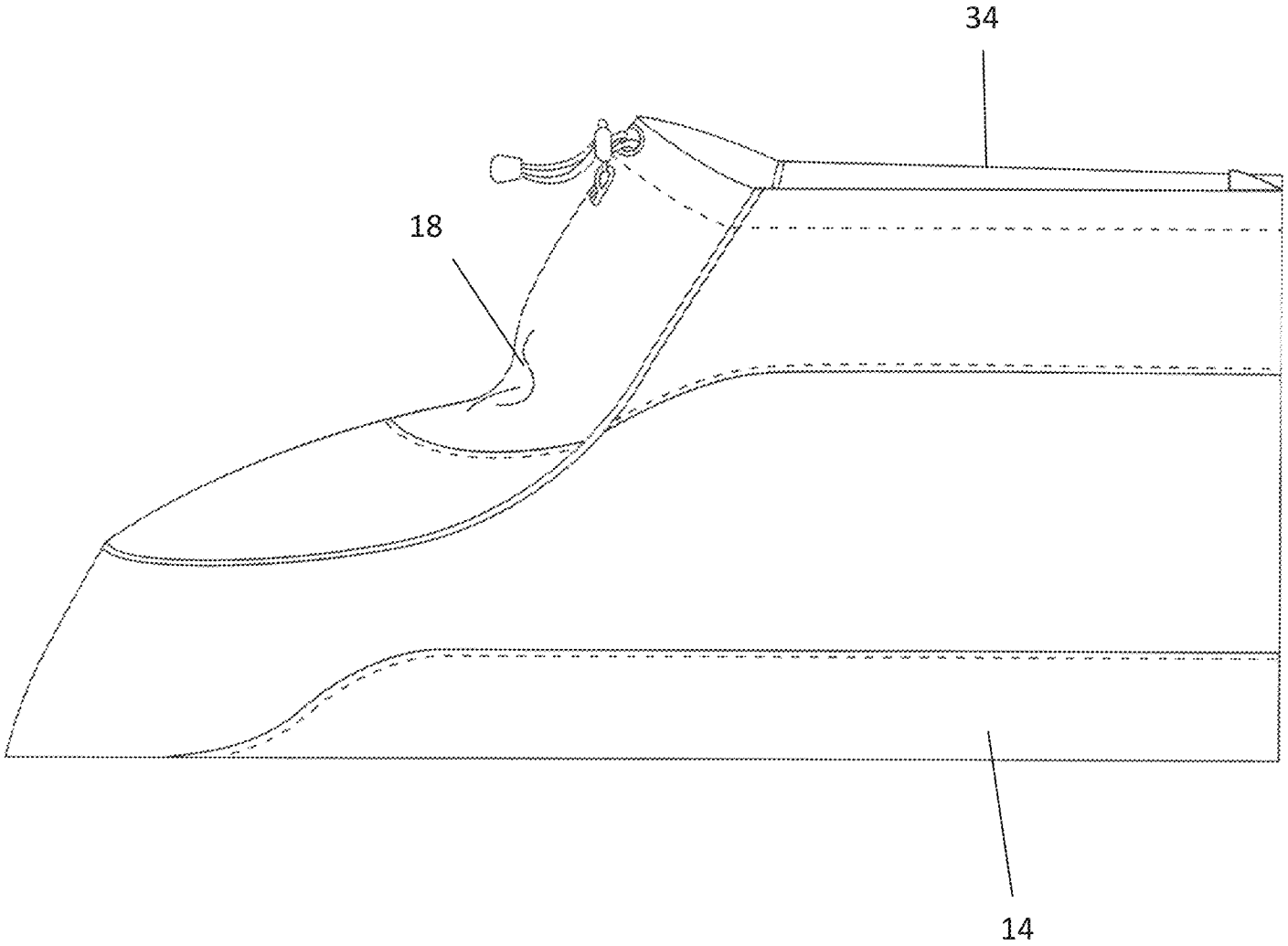
FIG. 2 is a left side view thereof.
Figure 3:
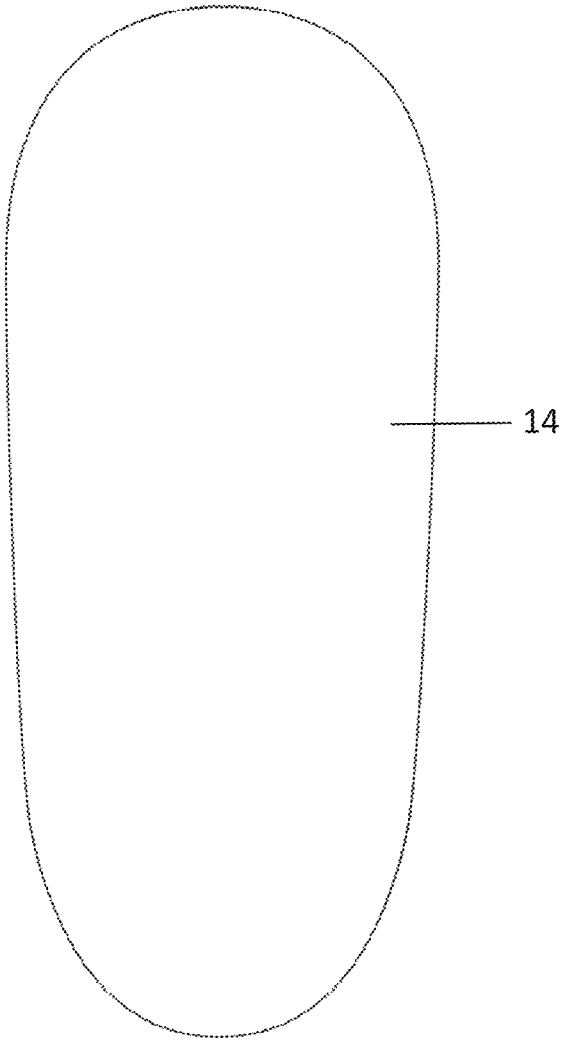
FIG. 3 is a bottom view thereof.
Figure 4:
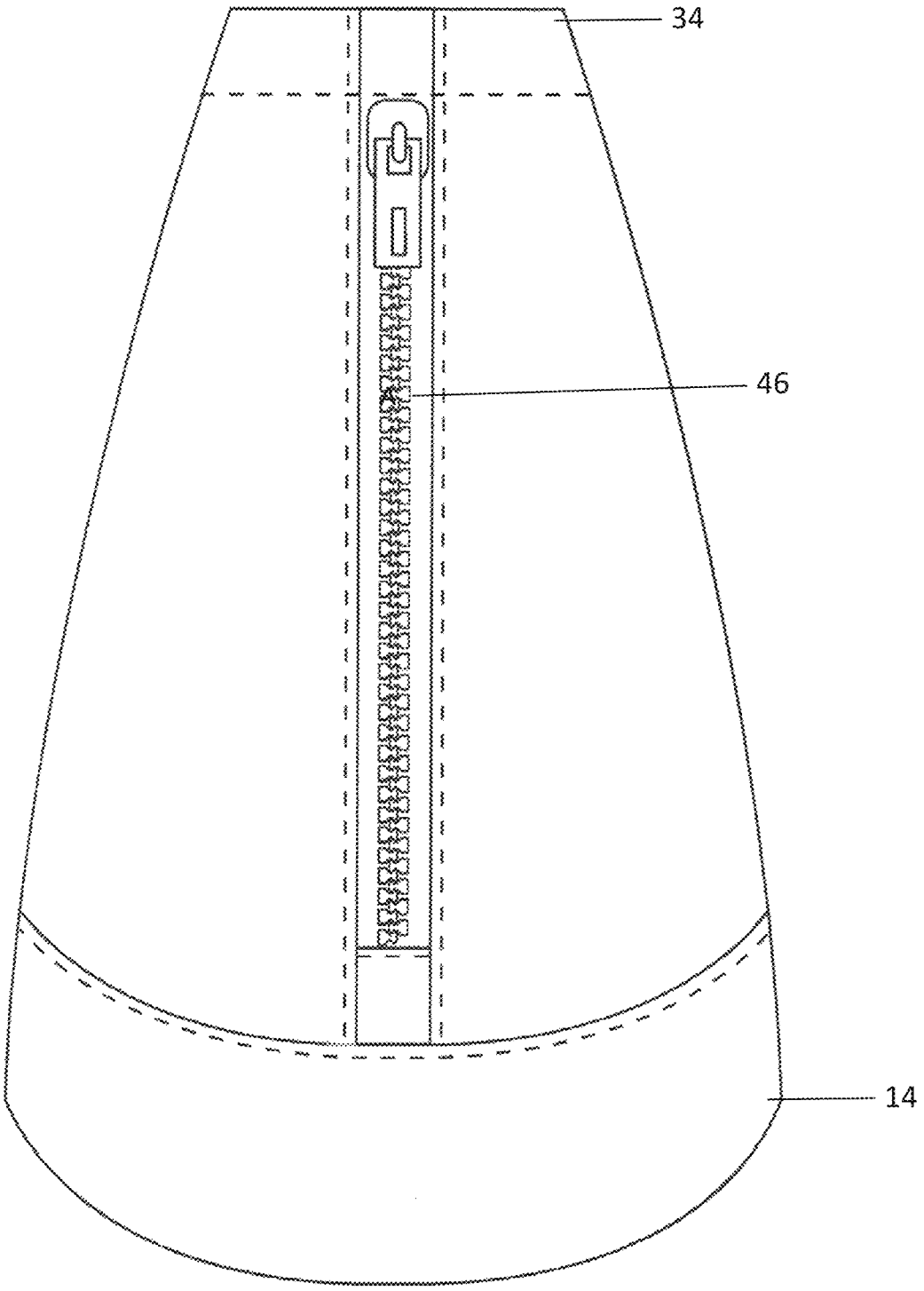
FIG. 4 is a back view thereof.
Figure 5:
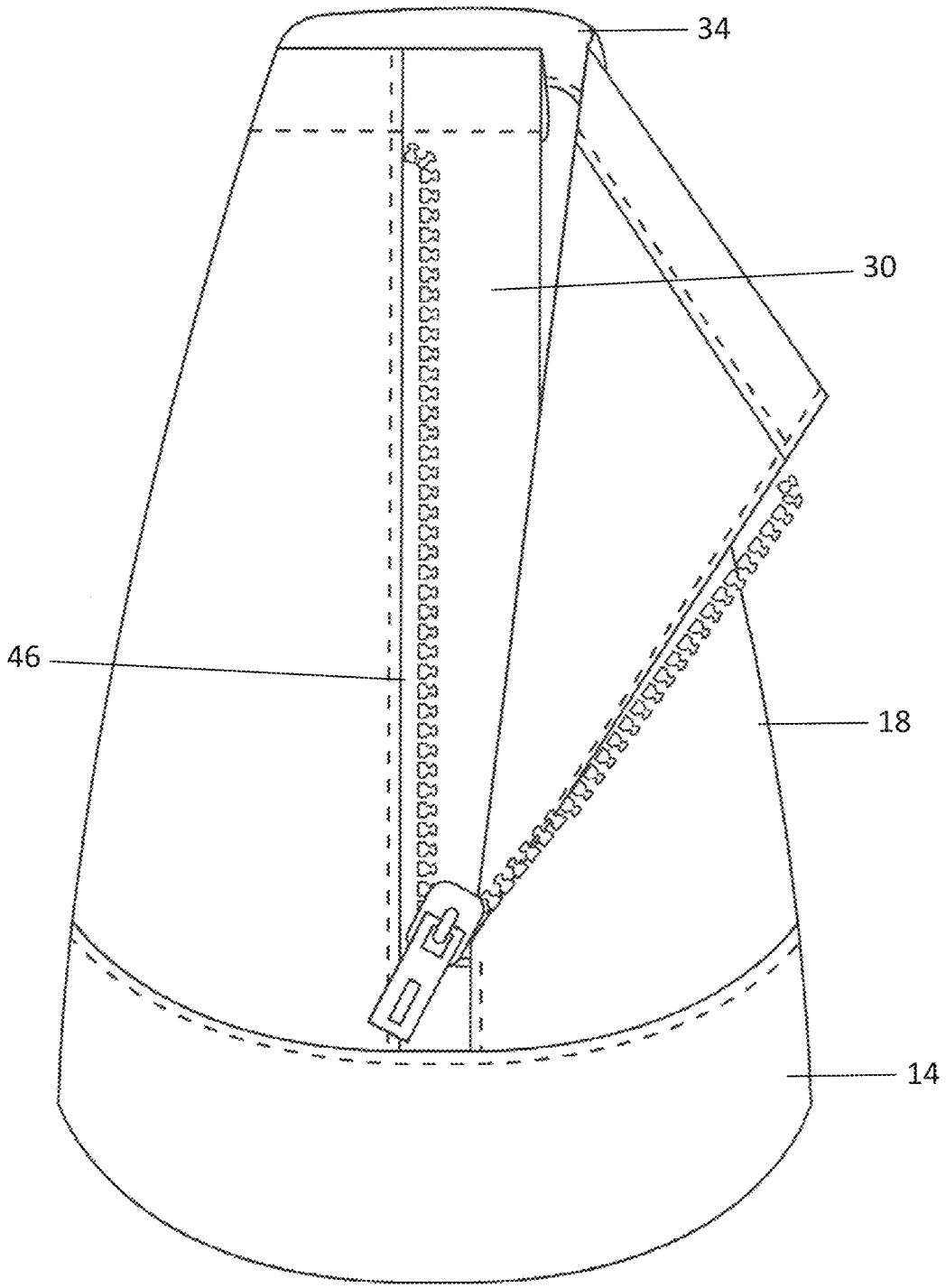
FIG. 5 a back view thereof.
Figure 6:
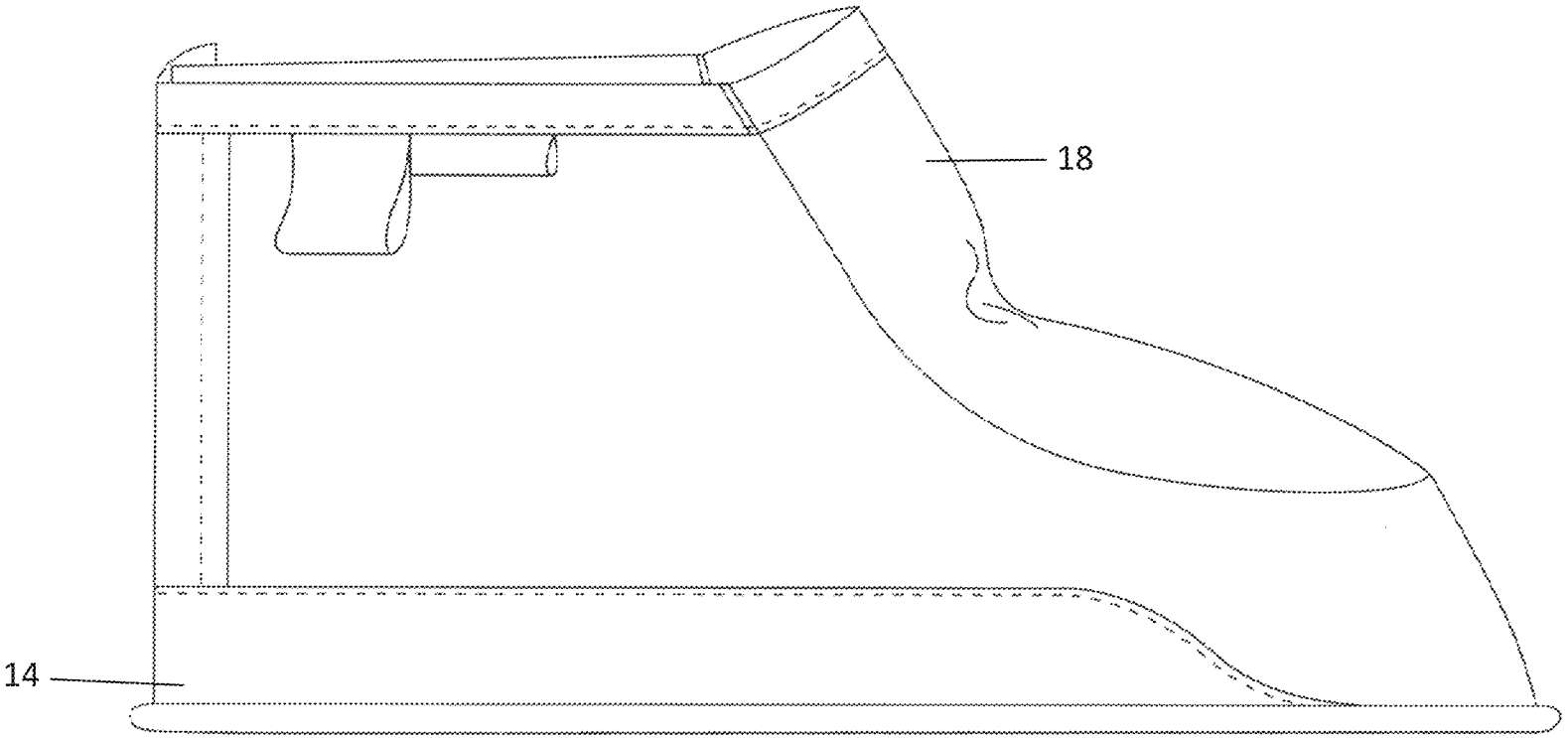
FIG. 6 is a right side view thereof.

Referring to FIGS. 1 through 6, the preferred embodiment of the heated boot cover 10 is illustrated. In the simplest version of the preferred embodiment the heated boot cover comprises an upper 18 connected to a sole 14. The upper 18 may be connected to the sole 14 by any number of means, such as sewing, adhesive, or ultrasonic welding. The upper end of the upper 18 defines an opening 34 for receiving the foot of a user. The upper 18 is shaped to define a cavity 30. The cavity 30 is shaped to receive a foot of a user. On the rear of the boot cover 10 is a fastener 46. In the preferred embodiment the fastener 46 is a zipper. As shown in FIG. 4, the zipper 46 is zipped toward the opening 34 so that the heated boot cover 10 completely enclosing the foot of the user. This closed position would be a secured position. As shown in FIG. 5, the zipper 46 is distant from the opening 34, which allows the user to remove or insert their foot from the cavity 30. This position would be an unsecured position. Where other types of fasteners are utilized, the fasteners would be in an unsecured position if the user can remove his foot from the cavity 30 and would be in a secured position if the user cannot remove his foot from the cavity 30. The heated boot cover 10 may be utilized outside of a boot, such that a user places his foot in a boot and then places his boot in the cavity 30 of the heated boot cover 10. Alternatively, the heated boot cover 10 may be utilized inside of a boot where the user places his foot inside the cavity 30 and then places the entire heated boot cover 10 inside of a boot. The sole 14 may be made of any material. In the preferred embodiment the sole 14 has a foam layer formed from any foam type, such as neoprene foam or sponge rubber, and a bottom sole layer formed from thick neoprene material, hardened rubber, or any other sturdy natural or synthetic material. The sole 14 may be formed to have traction or may be smooth.

Figure 7:
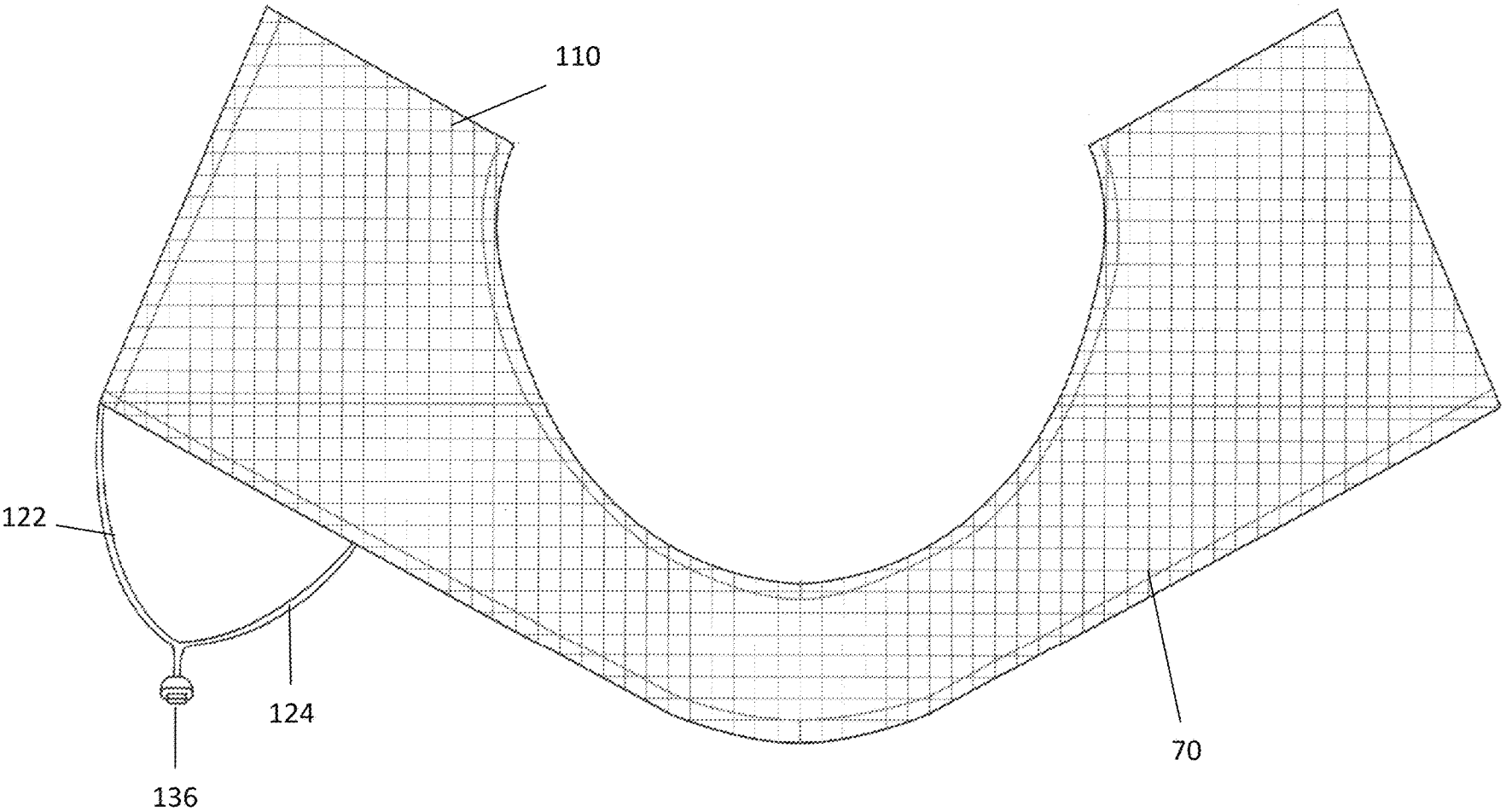
FIG. 7 is a top view of the electrically conductive material utilized in the upper of the boot cover.

Referring to FIG. 7, the heating layer of material is illustrated, identified as the electrically conductive layer 66 below. The heating layer is composed of a woven base 110 of non-conductive fibers, such as polyester and/or aramid fibers. Interwoven with the woven base 110 is one or more electrically conductive yarns 70. The electrically conductive yarns 70 may overlap or interweave with each other or may not cross over each other. The electrically conductive yarn 70 may be interwoven at any density per square inch of material. The electrically conductive yarns 70 have sufficient resistant to generate heat when electric current is applied. Extending from the heating layer of material are two wires 122, 124 which terminate in on or more connectors 136 which in turn can be connected to a battery.

Figure 8:
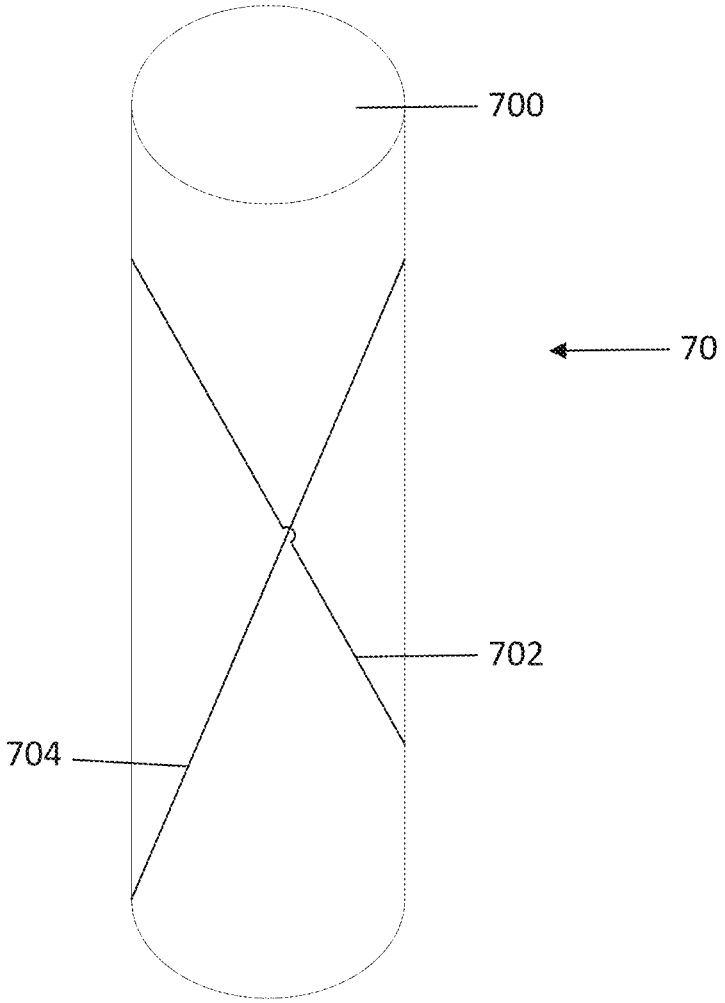
FIG. 8 is a top perspective view of the electrically conductive yarn utilized in the boot cover.

Referring to FIG. 8, the electrically conductive yarn 70 is illustrated. The conductive yarn comprises a core 700 and first electrical filament 702 and a second electrical filament 704. In some embodiments only a single electrical filament 702 is utilized. In the embodiment shown, the first electrical filament 702 wraps around the outer circumference of the core 700 in one direction and the second electrical filament 704 wraps around the outer circumference of the core in the opposite direction. In other embodiments the second electrical filament 704 may wrap around the core 700 in the same direction as the first electrical filament 702. The core 700 is composed of nonconductive yarn. The core 700 may be composed of a single yarn or a bundle of a plurality of yarn. If the core 700 is composed of a bundle of yarn then the electrical filaments 702, 704 may be wrapped around the outside or may be interwoven into the bundle of fibers in the core. The electrical filaments 702, 704 may be any size and shape and may be small round wires or may be flattened such that their width is greater than their depth.

Figure 9:
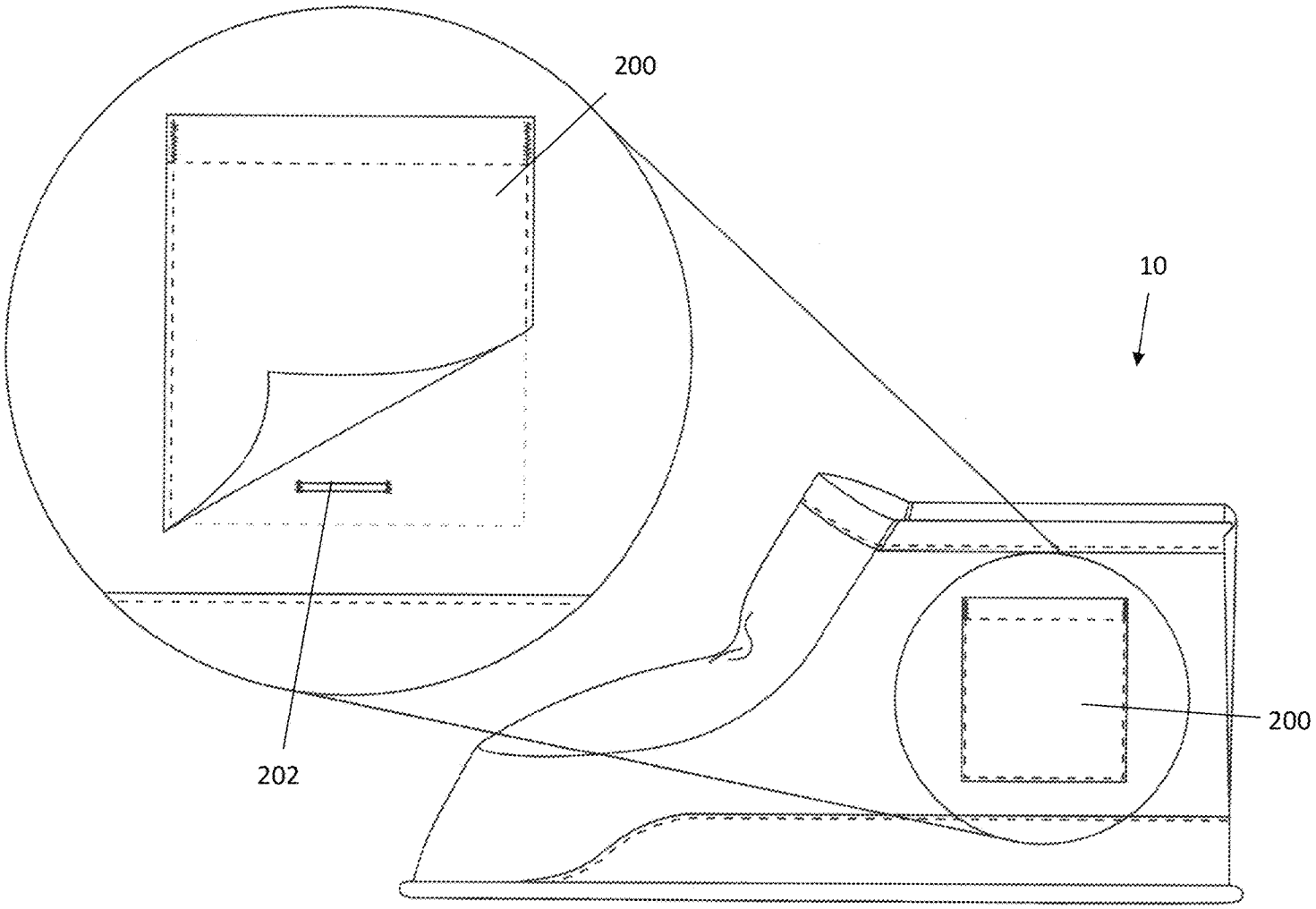
FIG. 9 is a left side view of the boot cover having a pocket.

Referring to FIG. 9, a heated boot cover 10 with a pocket 200 is illustrated. In this embodiment the heated boot cover 10 has a pocket 200 for holding a battery (not shown). Inside of the pocket 200 may be a slot 202. The slot 202 a hole in the outer layer of fabric of the heated boot cover 10 to allow the wires 122, 124 to pass through and connect with a battery being held in the pocket.

Figure 10:
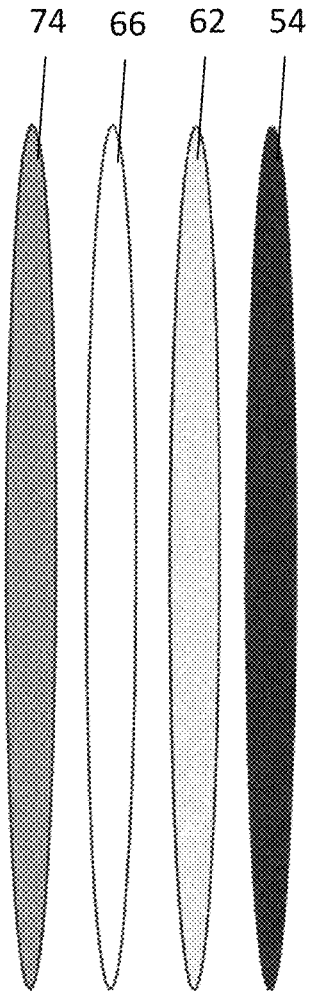
FIG. 10 is an exploded side view of the layers of materials utilized for the boot cover.
Figure 11:
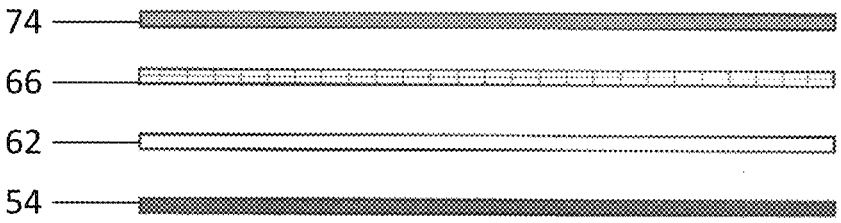
FIG. 11 is an exploded side view of the layers of materials utilized for the boot cover.

Referring to FIG. 10 and FIG. 11, the separate layers of material utilized in the heated boot cover 10 are illustrated. The separate layers may be attached together by physical means, such as sewing or heat sealing or ultrasonic welding, or chemical means, such as adhesive placed between the layers. The outer layer 54 faces the outside of the heated boot cover 10. The outer layer may be formed from a durable water repellant material, such as 1000 denier polyurethane coated nylon fabric. The polyurethane coating, together with the 1000 denier rating gives the outer layer higher water resistant properties than standard nylon or any other material. Adjacent to the outer layer 54 is the insulation layer 62. The insulation layer 62 is preferably composed of a synthetic fiber thermal insulation. The fibers utilized in the insulation layer 62 are preferably approximately 15 micrometres in diameter although other sizes of fibers may be used. Preferrably the insulation layer 62 has a thermal resistance R-value of 1.6 for 80-gram fabric to 2.9 for 200-gram fabric. The material used to make the insulation layer 62 may be any type of material but may be primarily made from polyethylene terephthalate or a mixture of polyethylene terephthalate and polypropylene. Other materials making up the insulation layer 60 may be polyethylene terephthalate-polyethylene isophthalate copolymer and acrylic. Adjacent to the insulation layer 62 is the electrically conductive layer 66. Adjacent to the electrically conductive layer 66, and the innermost layer of the material utilized, is the interior fabric layer 74. The interior fabric layer 74 may be made of any type of material. The material used for the interior fabric layer 74 may be cotton or wool or polyester. In the preferred embodiment the interior fabric layer is composed of 70 denier interlock polyester. The interior fabric layer 74 may also have a layer of ripstop nylon, either by itself or paired with the polyester.

Figure 12:
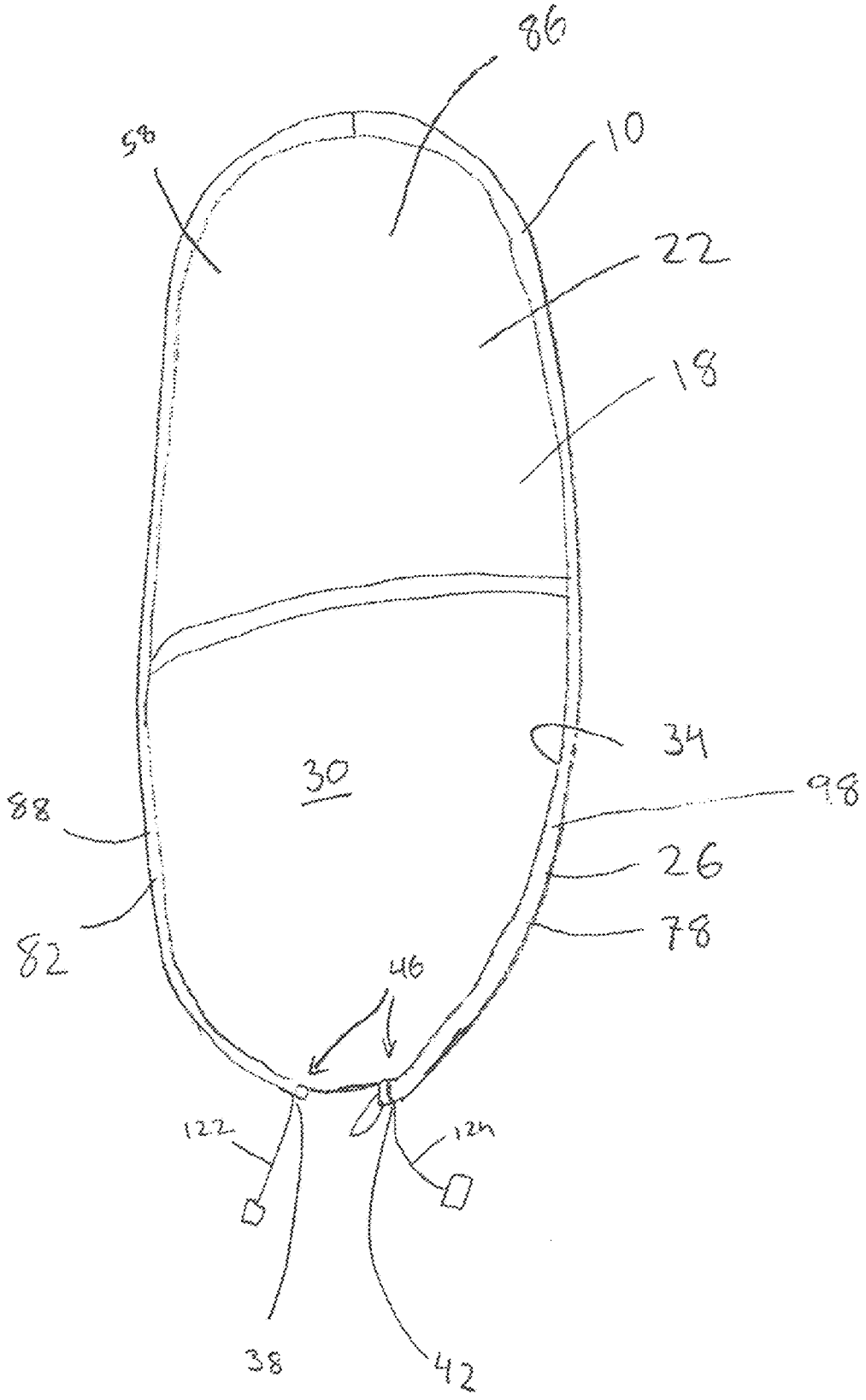
FIG. 12 is a top view of the boot cover.
Figure 13:
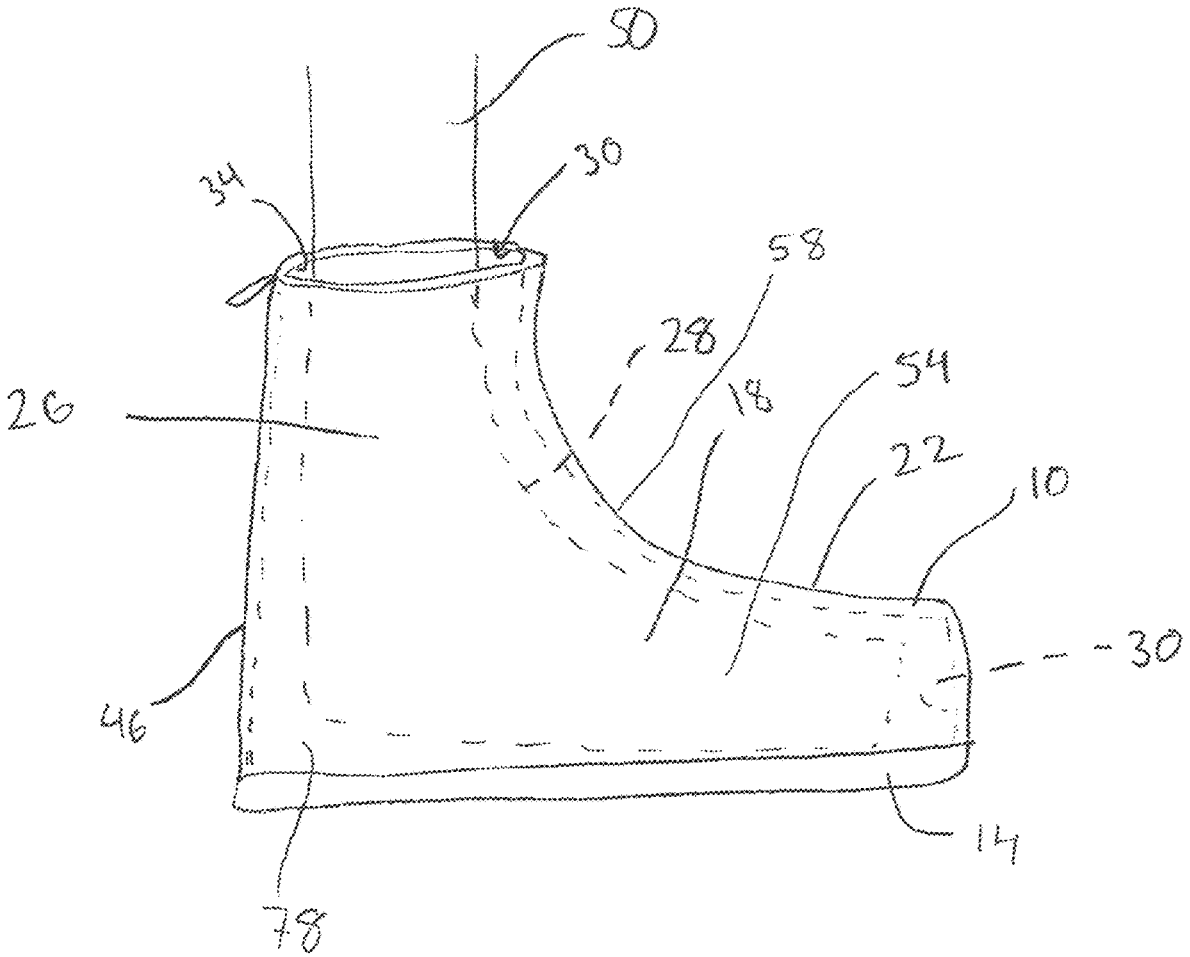
FIG. 13 is a side cross-sectional view thereof.

Referring to FIGS. 12 and 13, a heated boot cover 10 is schematically depicted. The boot cover 10 includes a sole 14 and an upper 18. The upper 18 includes a vamp portion 22 and a shaft portion 26. The sole 14 and the upper 18 cooperate to define a cavity 30 having an opening 34 at the top of the shaft portion 26.

The cavity 30 is sized and shaped to enclose and contain a boot 28. The upper 18 defines two edges 38, 42 adjacent to opening 34. The boot cover 10 includes a fastening system 46 that is configured to selectively and releasably connect edge 38 and edge 42. Thus, when the fastening system 46 is disengaged and the edges 38, 42 are movable with respect to each other, the size of the opening 34 is variable; edges 38 and 42 may be separated to enlarge opening 34 and thereby facilitate insertion or removal of the boot 28. When the fastening system 46 is engaged, the edges 38, 42 are adjacent one another and the size of the opening 34 is not variable. At its minimum size, with the fastening system 46 engaged, the opening 34 permits the leg 50 of the boot wearer to protrude from the cavity 30. In the embodiment depicted, the fastening system 46 is a zipper although other fastening systems may be employed within the scope of the claims. Other fastening systems that may be utilized include snaps, hooks and eyes, or any other metal fastening system.

Figure 14:
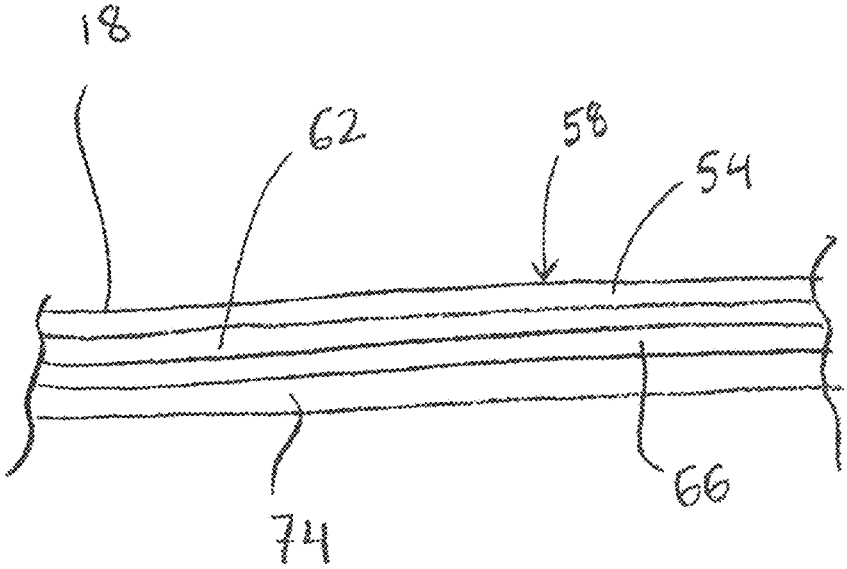
FIG. 14 is a cross-sectional view of the material utilized for the boot cover.

FIG. 14 is a cross-sectional view of the material forming the upper 18, and is representative of any portion of the upper 18. The upper 18 comprises four layers of material. One layer 54 of material defines the outer surface 58 of the upper 18. The layer 54 is a water resistant fabric having a high degree of abrasion, scuff, and tear resistance. In one embodiment, the layer 54 comprises polymeric yarn such as nylon 66. The yarn may, for example, be arranged in a broad weave, e.g., plain dobby, basket or rip-stop weaves; or knit, e.g., circular, flat, or warp knits. One example of a material for layer 54 is Cordura® from Invista.

Layer 62 contacts layer 54 and functions as an insulator. In one embodiment, layer 62 comprises polymeric fibers that are hydrophobic. The fibers may be siliconized. One example of a commercially available material for layer 62 is Thinsulate™ Water Resistant Insulation from 3M™. Layer 66 includes electrically conductive material (shown at 70A, 70B, 70C in FIG. 5). Layer 74 secures layers 54, 62, and 66 together. Layer 74 also protects layer 66 from tears and abrasions that could occur in layer 66 if the boot 28 came into contact with layer 66. One example of material that may be employed in layer 74 is ripstop nylon. The layers 54, 62, 66, 74 are attached to each other such as by sewing or stitching, though other techniques may be employed within the scope of the claims. In other embodiments the layers of material are glued together with adhesive. In other embodiments the layers are adhered together by ultrasonic welding or heat sealed together.

Figure 15:
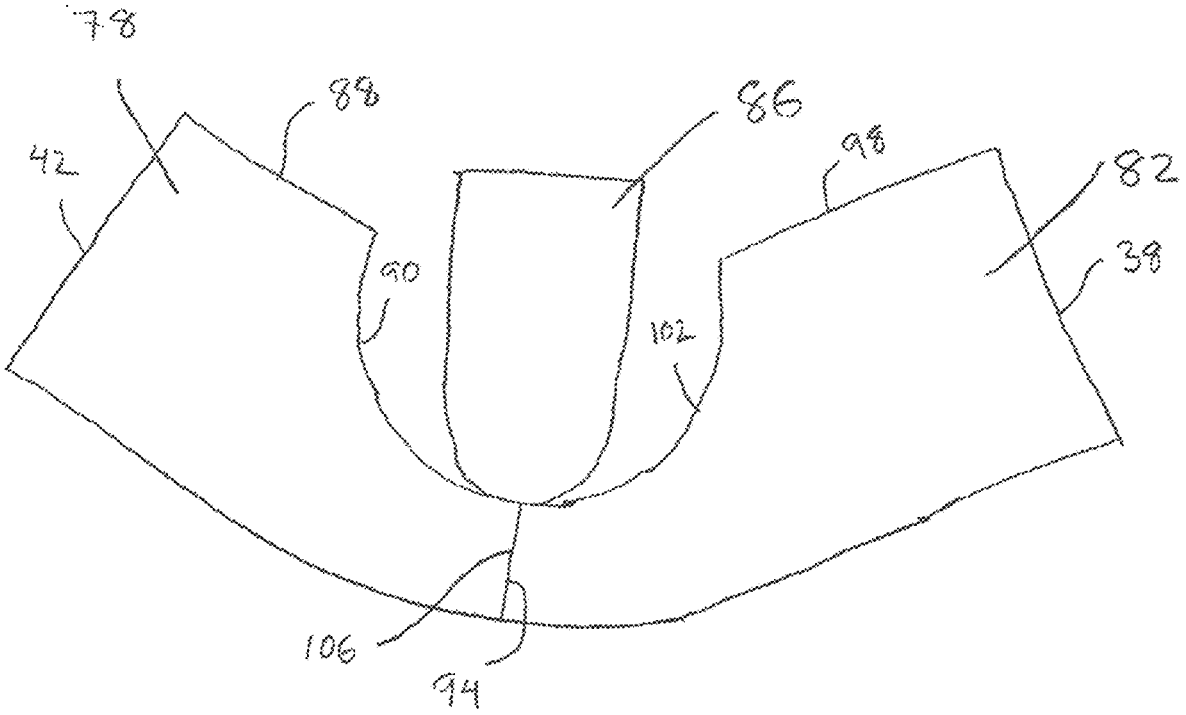
FIG. 15 is a top view of the upper of the boot cover.

Referring to FIG. 15, panels 78, 82, 86 are schematically depicted. Panels 78, 82, 86 are depicted prior to assembly to form the upper 18. Each of panels 78, 82, 86 comprises the four layers of material (shown at 54, 62, 66, 74) in FIG. 3. Panel 78 includes an edge 88 that partially defines opening 34, edge 42, a curvilinear edge 90, and edge 94. Similarly, panel 82 includes an edge 98 that partially defines opening 34, edge 38, a curvilinear edge 102, and edge 106. Panel 86 forms the upper portion of the vamp portion 22. Curvilinear edges 90, 102 are connected to panel 86; edges 94 and 106 are connected to each other at the toe section of the upper 18.

Figure 16:
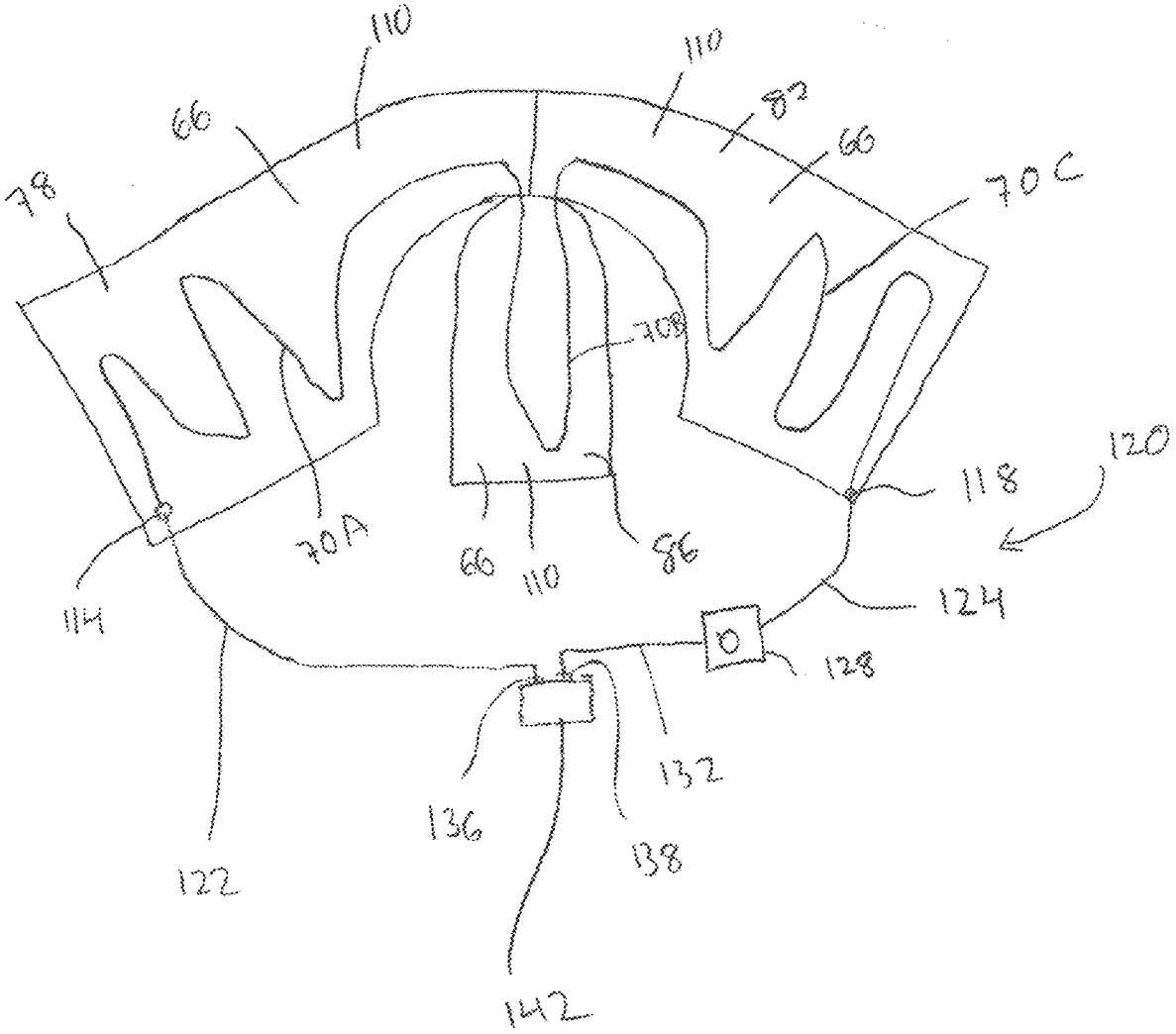
FIG. 16 is a schematic top view of the electrically conductive material used to form the upper of the boot cover.

Referring to FIG. 16, wherein like reference numbers refer to like components from FIGS. 12-15, layer 66 of panels 78, 82, 86 is schematically depicted. The layer 66 includes a woven base 110 of non-conductive fibers, such as polyester and/or aramid fibers (e.g., Nomex® available from DuPont). The layer 66 also includes electrically conductive yarns 70A, 70B, 70C interwoven with the non-conductive fibers of the base 110. The conductive yarns 70A, 70B, 70C have sufficient resistant to generate heat when electric current is applied.

More specifically, conductive yarn 70A is within panel 78 and extends from an electrical terminal 114 to conductive yarn 70B, which extends through panel 86. Conductive yarn 70B is in electrical communication with yarn 70C, which extends through panel 82. Conductive yarn 70C terminates at electrical terminal 118. The routes of yarns 70A, 70B, 70C depicted are merely exemplary, and may be modified within the scope of the claims to vary the heat distribution throughout the upper 18. Furthermore, the yarns 70A, 70B, 70C are shown connected in series; however, and within the scope of the claims, yarns may be connected in parallel. Yarns 70A, 70B, 70C form a portion of an electrical circuit 120.

Yarns 70A, 70B, 70C may comprise a non-conductive textile core with a metallic conductive filament wrapped around it in, for example, a helical pattern. Examples of conductive yarns that may be employed within the scope of the invention are described in U.S. Pat. No. 5,927,060, issued Jul. 27, 1999 to Watson; U.S. Pat. No. 9,719,194, issued Aug. 1, 2017 to Chi-Hsueh, and U.S. Patent Publication No. 2010/0300060 (HSU et al.), published Dec. 2, 2010; each of the aforementioned patent documents being hereby incorporated by reference in their entireties. Metallic filament size and metal composition may be altered to achieve the desired resistance for heat generation.

The boot cover 10 includes electrical wires 122, 124 in electrical communication with terminals 114, 118, respectively. One of the wires, e.g., wire 124, is connected to a control 128 configured to selectively vary the amount of current flowing through the circuit 120, and thereby controlling the amount of heat generated by the conductive yarns 70A, 70B, 70C. For example, control 128 may be a variable resistor or a device having a plurality of resistors that may be selected by a user. In a preferred embodiment, control 128 includes at least three resistance settings. Control 128 is in electrical communication with wire 132. Wires 132 and 122 terminate at respective electrical connectors 136, 138. Electrical connectors 136, 138 are releasably engageable with a rechargeable battery 142. In one embodiment, layer 74 defines a pocket for storage and retention of the battery 142 and control 128.

Figure 17:
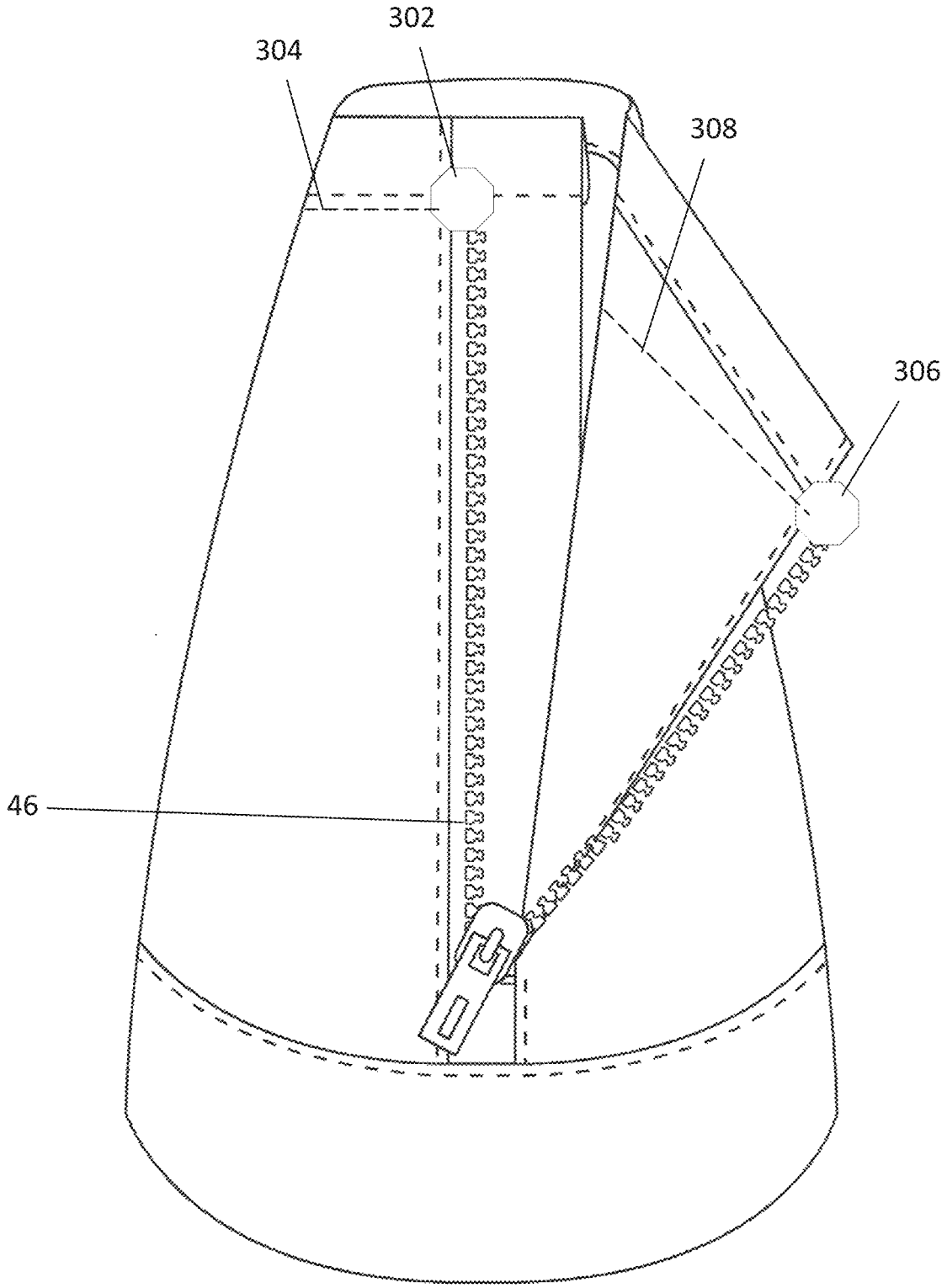
FIG. 17 is a rear view of the boot cover.

Referring to FIG. 17, another embodiment of the heated boot cover is illustrated. In this embodiment the fastener 46 has a first electrical connector 302 connected to a first wire 304 and a second electrical connector 306 connected to a second wire 308. In the embodiment illustrated the first electrical connector 302 and second electrical connector 306 are disposed at the top of the zipper 46. When the zipper 46 is zipped up to completely enclose the cavity 30, the first electrical connector 302 engages the second electrical connector 306 to complete the circuit and allow electricity to flow through the electrically conductive yarn 70 and allow the cover to generate heat. If a user unzips the zipper 46 to remove the heated boot cover 10, then the first electrical connector 302 disengages the second electrical connector 306 and the heated boot cover 10 is unable to generate heat. In this manner, the heated boot cover can only generate heat when the fastener 46 is fully engaged. The first electrical connector 302 and second electrical connector 306 may be utilized in any shape or configuration. The first electrical connector 302 and second electrical connector 306 may be placed at the top of a zipper or in the middle of a zipper. In other embodiments the first electrical connector 302 and second electrical connector 306 are shaped as snaps which can be releasably secured together. If configured as snaps then the first electrical connector 302 and second electrical connector 306 may be positioned toward the top of the rear, towards the opening 34, distal from the opening 34, or may be placed on separate strips of fabric which span the opening formed when the fastener 46 is disengaged. The first electrical connector 302 and second electrical connector 306 may be integral to the fastener 46 or separate from the fastener 46.

Figure 18:
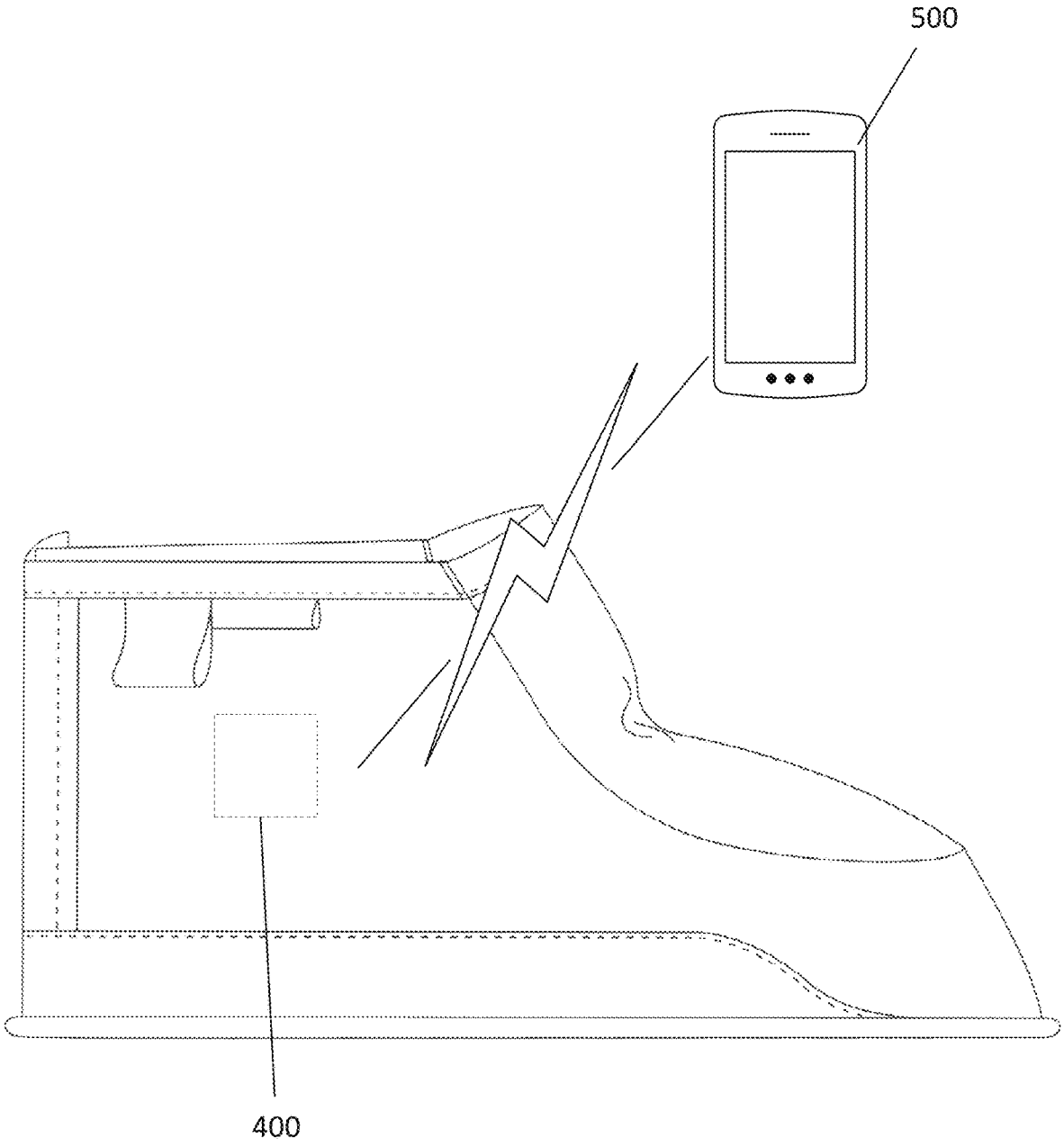
FIG. 18 is a schematic of the boot cover in communication with a smartphone.

Referring to FIG. 18, the heated boot cover 10 may be configured to be operated by a client application running on a smartphone 500. The heated boot cover 10 may have a master control unit 400 with a transceiver. The master control unit 400 may have a processor and memory built in. In other embodiments there may only be a transceiver without full processing capabilities. In other embodiments the transceiver is separate from the master control unit 400. In this embodiment the client application on the smartphone 500 can send a signal to the master control unit 400 to turn the heating on or off or adjust the level of heat generated. The client application on the smart phone 500 may be paired with one or more pairs of heated boot covers 10. The client application on the smart phone 500 may also have one or more sets of parameters preprogrammed to control the operation of the heated boot cover. For instance, the smart phone 500 may establish that the heated boot cover 10 generates heat only for a certain amount of time or cycles between periods of time of generating heat and periods of time when no heat is generated. The smart phone 500 may also alter the amount of heat generated at any time. The smart phone 500 may also receive status information from the master control unit 400, such as battery life remaining or power usage.

Figure 19:
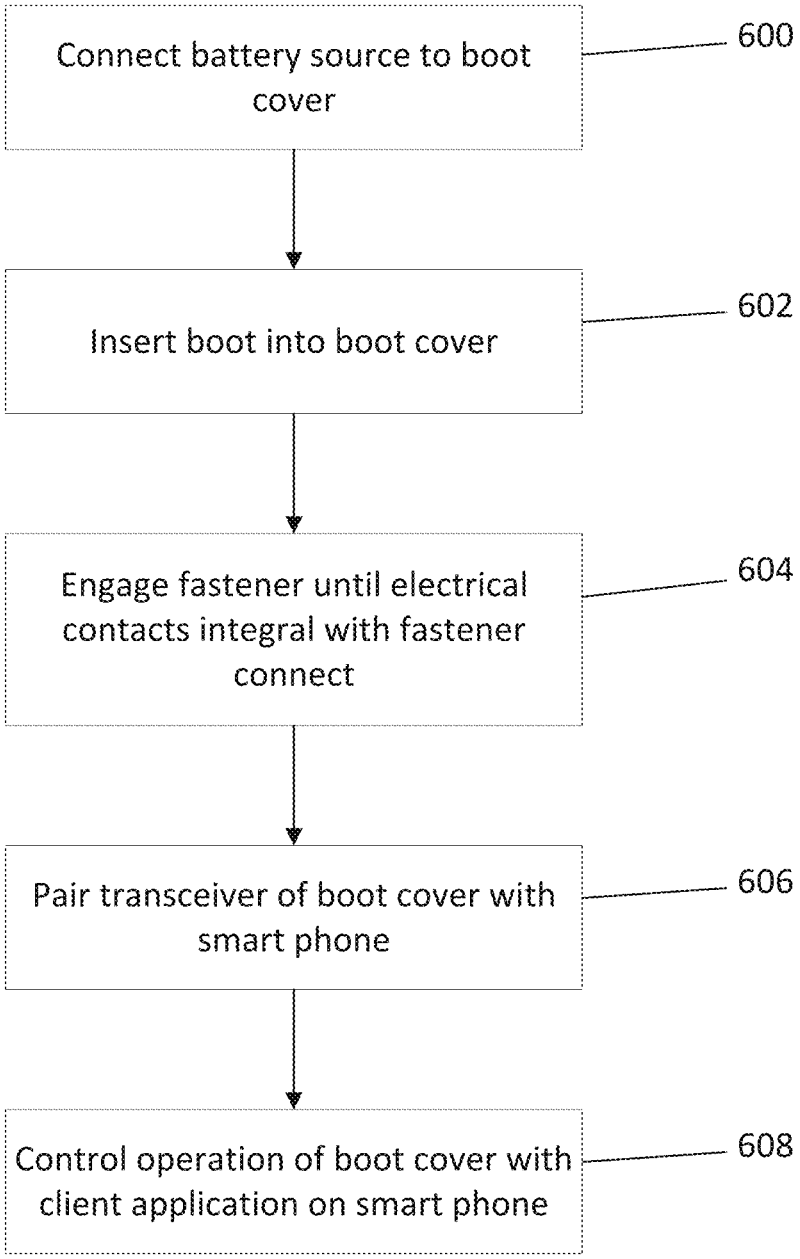
FIG. 19 is a schematic of the method of utilizing the boot cover.

Referring to FIG. 19, the method of use of the heated boot cover 10 is illustrated. First, the user connects a battery source to the heated boot cover 600. Next the user inserts a boot into the cavity of the heated boot cover 602. Next the user engages the fastener until electrical contacts that are integral to the fastener connect 604. Next the user pairs the transceiver of the mater control unit with a client application on a smart phone and controls the operation of the heated boot cover with the client application on the smart phone 608.

The heated boot cover 10 may have a number of additional elements or other configurations without departing from the scope of the invention. For instance, the heated boot cover may have a draw string, laces, ties, to help cinch or tighten the heated boot cover 10. The heated boot cover 10 may have one or more loops of fabric which would permit easy handling of the boots when not being worn. The heated boot cover 10 may have detachable connection wires between the two boots so that the boots may be connected together into a continuous circuit. In this manner two boot covers 10 may be operated off of the same battery if the battery in one boot cover dies. Additionally, the boot cover 10 may have direct plugs for plugging the battery in the boot covers 10 directly into an electrical outlet in a wall.0

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In one or more exemplary aspects, the functions described may be implemented in hardware, software, firmware, or any combination thereof. If implemented in software, the functions may be stored on or transmitted over as one or more instructions or code on a computer-readable medium. The steps of a method or algorithm disclosed herein may be embodied in a processor-executable software module, which may reside on a tangible, non-transitory computer-readable storage medium. Tangible, non-transitory computer-readable storage media may be any available media that may be accessed by a computer. By way of example, and not limitation, such non-transitory computer-readable media may comprise RAM, ROM, EEPROM, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of non-transitory computer-readable media. Additionally, the operations of a method or algorithm may reside as one or any combination or set of codes and/or instructions on a tangible, non-transitory machine readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A shaped personal heating apparatus comprising:

a) an upper;

b) a sole connected to said upper;

c) a fastener coupled to said upper and having a secured position and an unsecured position; and, d) a first electrical contact element coupled to a first portion of said fastener and a second electrical contact element coupled to a second portion of said fastener, wherein:

said upper and said sole define a cavity, said upper comprises a first layer facing externally from said personal heating apparatus, a second layer disposed adjacent to said first layer, a third layer disposed adjacent to said second layer, and a fourth layer disposed adjacent to said third layer, said fourth layer is disposed facing said cavity, said third layer comprises an electrically conductive material, said second layer comprises a thermal insulation material having a thermal insulation value higher than a thermal insulation value of said first layer and a higher thermal insulation value of said third layer, electricity is configured to flow through said electrically conductive material only when said first electrical contact element and said second electrical contact element are in physical contact, and, said first electrical contact element and said second electrical contact element are configured to only be in physical contact when said fastener is in said secured position.

2. The personal heating apparatus of claim 1 wherein said upper is shaped to include a vamp portion and a shaft portion and wherein said electrically conductive material extends through said vamp portion and said shaft portion.

3. The personal heating apparatus of claim 1 wherein said electrically conductive material further comprises a non-conductive textile core and one or more metallic conductive filaments wrapped around said non-conductive textile core.

4. The personal heating apparatus of claim 3 wherein said electrically conductive material has a width and a depth and wherein said width of said electrically conductive material is greater than said depth.

5. The personal heating apparatus as in claim 1 wherein said electrically conductive material comprises a non-conductive textile core and one or more metallic conductive elements;

a) wherein said non-conductive textile core comprises a plurality of textile filaments; and, b) wherein a portion of said non-conductive textile core is configured to have said one or more metallic conductive elements interwoven with one or more of said plurality of textile filaments.

6. The personal heating apparatus as in claim 1 further comprising a battery electrically connected to said electrically conductive material of said third layer.

7. The personal heating apparatus of claim 1 further comprising:

a microprocessor configured to control operation of said electrically conductive material; and, a transceiver in operative communication with a remote computerized device.

8. The personal heating apparatus of claim 1:

a) wherein said first layer comprises a polyurethane coated nylon fabric;

b) wherein said second layer comprises a synthetic fiber insulation having a normal resistance value in a range R 1.6 to R 2.9;

c) wherein said third layer further comprises a woven non-conductive base; and d) wherein said fourth layer comprises ripstop nylon.

9. The personal heating apparatus of claim 8 wherein said electrically conductive material further comprises a non-conductive textile core and one or more metallic conductive filaments wrapped around said non-conductive textile core.

10. The personal heating apparatus as in claim 1 further comprising a battery electrically connected to said electrically conductive material of said third layer.

11. The personal heating apparatus as in claim 1 wherein said first electrical contact element is integral to said first portion of said fastener.

12. The personal heating apparatus as in claim 1 wherein second electrical contact element is integral to said second portion of said fastener.

13. The personal heating apparatus of claim 1 further comprising a microprocessor configured to control operation of said electrically conductive material; and, a transceiver in operative communication with a remote computerized device.

* * * * *